United States Patent [19]

Pye

[11] 4,161,222

[45] Jul. 17, 1979

[54] METHOD FOR REDUCING CONTAMINANT EMISSIONS IN GAS DRILLING OPERATIONS

[75] Inventor: David S. Pye, Brea, Calif.

[73] Assignee: Union Oil Company of California, Brea, Calif.

[21] Appl. No.: 911,423

[22] Filed: Jun. 1, 1978

[51] Int. Cl.[2] ..... E21B 21/00

[52] U.S. Cl. ..... 175/66; 175/71

[58] Field of Search ..... 175/65, 66, 69, 71

[56] References Cited

U.S. PATENT DOCUMENTS

| | | | |
|---|---|---|---|
| 2,701,122 | 2/1955 | Grable | 175/66 X |
| 2,786,652 | 3/1957 | Wells | 175/71 X |
| 3,208,539 | 9/1965 | Henderson | 175/71 X |
| 3,372,761 | 3/1968 | Van Gils | 175/65 X |
| 3,415,331 | 12/1968 | Van Gils | 175/65 |
| 3,500,943 | 3/1970 | Bingman, Jr. | 175/66 |
| 3,653,452 | 4/1972 | Fischer et al. | 175/69 |
| 3,827,511 | 8/1974 | Jones | 175/25 |
| 3,920,090 | 11/1975 | McQueen et al. | 175/71 X |
| 3,977,478 | 8/1976 | Shuck | 175/71 X |
| 3,995,705 | 12/1976 | Fischer et al. | 175/71 X |

FOREIGN PATENT DOCUMENTS

71/6341 5/1972 South Africa.

OTHER PUBLICATIONS

Angel, R. R., "Volume Requirements for Air or Gas Drilling", *Petroleum Transactions, AIME*, vol. 210, 1957, pp. 325–330.

Dittmer, A. K., "Borehole Stability in Arkoma Basin Air/Gas Drilling Operations," API Paper No. 851-4-1-J, Mar. 1967.

Dorfman, M., "Drilling in the Geysers Field," *The Drilling Contractor*, Nov.-Dec. 1973, pp. 36–39.

Castrantas et al., "Hydrogen Sulfide Abatement at Geothermal Wells," Geothermal Environmental Seminar, Oct. 28, 1976.

Hook et al., "Air, Mist and Foam Drilling: A Look at Latest Techniques," Part I, *World Oil*, Apr. 1977, pp. 95–106; Part II, *World Oil*, May 1977, pp. 83–87.

Robie, M. D., "Design Change Produces Better Tool Joints for Air Drilling," *Oil and Gas Journal*, Jun. 20, 1977, pp. 72–74.

*Primary Examiner*—Stephen J. Novosad
*Assistant Examiner*—George A. Suchfield
*Attorney, Agent, or Firm*—Richard C. Hartman; Dean Sandford; Daniel R. Farrell

[57] ABSTRACT

An improved gas drilling method for drilling a well through steam-bearing formations in which emissions of particulate material and other contaminants are reduced by imposing a surface back pressure on, and thereby reducing the velocity of, the contaminant-bearing gas rising through the well. The drilling cuttings and other particulate material rising through the well are subjected to less abrasion and therefore arrive at the surface as larger, more easily separated particles. Drill string erosion is also reduced by the method and the efficiencies of any well effluent treatment facilities are increased.

17 Claims, 2 Drawing Figures

METHOD FOR REDUCING CONTAMINANT EMISSIONS IN GAS DRILLING OPERATIONS

BACKGROUND OF THE INVENTION

1. Field of the Invention

This invention relates to a method for conducting gas drilling operations, and more particularly concerns a method for conducting gas drilling operations to reduce the contaminant emissions during the drilling of a well through steam-bearing formations.

2. Description of the Prior Art

In conventional gas drilling operations, a gaseous drilling fluid, such as air, nitrogen, natural gas or other gaseous fluid, is passed from the earth surface downwardly through the drill pipe, outwardly through a rotary drill bit attached to the lower end of the drill pipe, and then upwardly through the annulus between the drill pipe and the walls of the borehole to the earth surface. Gas drilling using reverse circulation, wherein the gaseous drilling fluid is circulated downwardly through the well annulus and then upwardly through the drill pipe, is also known. The gaseous drilling fluid is circulated through the well at a volumetric flow rate sufficient to cool and drill bit and to lift the particulate drilling cuttings to the earth surface. In general the volumetric flow rate is selected such that the velocity of the solids-bearing gas rising through the well is sufficient to entrain the drilling cuttings and other solid particles found in the borehole. The prior art teaches that certain minimum velocities, and therefore minimum volumetric flow rates, are required and that velocities higher than this minimum velocity are preferred due to the very serious consequences of using an insufficient volumetric flow rate, e.g. a stuck drill pipe.

The solids-bearing gas rises through the well at velocities on the order of 10 to 100 feet per second, and higher. Solid particles transported at these velocities are highly abrasive and therefore erode the drill pipe and other metal surfaces to which they are exposed. Colisions between the particles and abrasion against the metal surfaces causes an overall diminution in size of the entrained particles. While the smaller particles are more easily entrained in the gas for removel from the borehole, they are more difficult to remove from the solids-bearing gas at the earth surface and therefore are usually vented to the atmosphere.

The problems of drill pipe erosion and contaminant emissions associated with gas drilling operations are further accentuated when drilling a well through steam-bearing formations, such as are encountered in the development of geothermal reservoirs. Since these formations have high temperatures, which can be in the order of 500° F. or higher, and often contain corrosive brines, sulfurous compounds and carbon dioxide, corrosion and erosion of the drill pipe, casing and other metal surfaces in the well are often excessive. Also, as steam enters the borehole from the surrounding formation, the velocity of the solids-bearing gas rising through the well is substantially increased, even as high as sonic velocities, which further increases the erosion of metal surfaces exposed to this gas. The useful life of drill pipe employed under these conditions is relatively short, which fact alone may render impractical the use of gas drilling for a particular well.

The higher veolcities in the well also result in further diminution of the solids entrained in the gas rising through the well. A substantial fraction of the solids are reduced to particles with characteristic diameters of 2 microns and less. The removal of such fine particles from a large volume, high velocity gas stream is not practical with conventional separator devices, such as cyclones or filters. After passing the well effluent through the separator device, the gas, which still contains the finely divided solids, is conventionally vented to the atmosphere.

Emissions of particulate material and other contaminants, such as hydrogen sulfide, during the gas drilling of wells through steam-bearing strata have become a matter of environmental and regulatory concern. These emissions are often serious enough to render impractical the use of the otherwise desirable gas drilling techniques. Wells which are drilled during the development of a geothermal reservoir using other drilling techniques, such as drilling with oil or mud-based drilling fluids, often have much poorer steam production characteristics as compared to a well drilled by gas drilling techniques. Thus, there is a need for a method of conducting gas drilling operations in which contaminant emissions are reduced to a practical level.

Accordingly, it is a principal object of this invention to provide a method for reducing contaminant emissions during gas drilling operations.

Another object of this invention is to provide an improved method for drilling a well through steam-bearing formations in which the erosion of metal surfaces in the well and the emission of particulate material and other contaminants are reduced.

Yet another object of this invention is to provide an improved method for drilling a well through steam-bearing formations in which the emissions of contaminant-bearing steam is reduced and the high steam productivity of the well is maintained.

A further object of this invention is to provide an improved method for drilling a well through steam-bearing formations in which the emission of particulate material and other contaminants is reduced and the useful life of the drill pipe and other metal surfaces exposed to the solid-bearing gas rising through the well is increased.

Further objects, advantages and features of the invention will become apparent to those skilled in the art from the following description taken in conjunction with the accompanying drawings.

SUMMARY OF THE INVENTION

Briefly, the invention provides an improved gas drilling method for drilling a well through a steam-bearing subterranean formation wherein a preselected surface back pressure is imposed on the steam- and contaminant-bearing gas rising through the well to control the velocity of this gas at two critical points in the well. The surface back pressure is selected to reduce the velocity of the contaminant-bearing gas at the maximum velocity point in the well to a value below that velocity at which substantial erosion of well hardware and substantial diminution of the drilling cuttings occurs, and to control the velocity of the contaminant-bearing gas at the minimum velocity point in the well at a value sufficient to transport the drilling cuttings through the well to the earth surface. As a result of the imposed surface back pressure, erosion of the well hardware is reduced and the solids conveyed in the well effluent arrive at the earth surface as relatively large, more easily separated particles.

In one preferred embodiment of the method of this invention, the surface back pressure is imposed by installing a flow restricting device in the blooie line through which the well effluent is conducted from the wellhead, and means for injecting a treating fluid is installed in the blooie line upstream of the restricting device. The treating fluid is injected into the blooie line for physical and/or chemical interaction with the contaminants in the well effluent to facilitate separation of the contaminants and/or to convert the contaminants to environmentally innocuous compounds.

The method of the invention provides a simple but effective method for substantially reducing particulate emissions during a gas drilling operation while at the same time reducing drill pipe erosion and allowing more complete removal of chemical contaminants. The method of this invention provides the important advantage of being operational under the same conditions of high steam production during drilling which render the prior art gas drilling methods impractical due to excessive contaminant emissions and/or drill pipe erosion. Furthermore, the method of the invention significantly improves the overall efficiency of the conventional gas treating facilities employed in gas drilling operations, thereby effecting a surprisingly large decrease in contaminant emissions without adversely affecting any of the advantageous characteristics of the gas drilling operation.

BRIEF DESCRIPTION OF THE DRAWINGS

The invention will be more readily understood by reference to the drawings, in which.

DETAILED DESCRIPTION OF THE INVENTION

The method of this invention is applicable to all gas drilling operations in which steam-bearing formations are to be penetrated, and finds particular utility in the gas drilling of a well through steam-bearing formations during the development of a geothermal reservoir. While the method of this invention will be described in conjunction with the development of a geothermal reservoir, it is to be recognized that the method has broad application to all gas drilling operations in which steam entry into the well results in high contaminant emissions and excessive drill pipe erosion.

Figure 1:
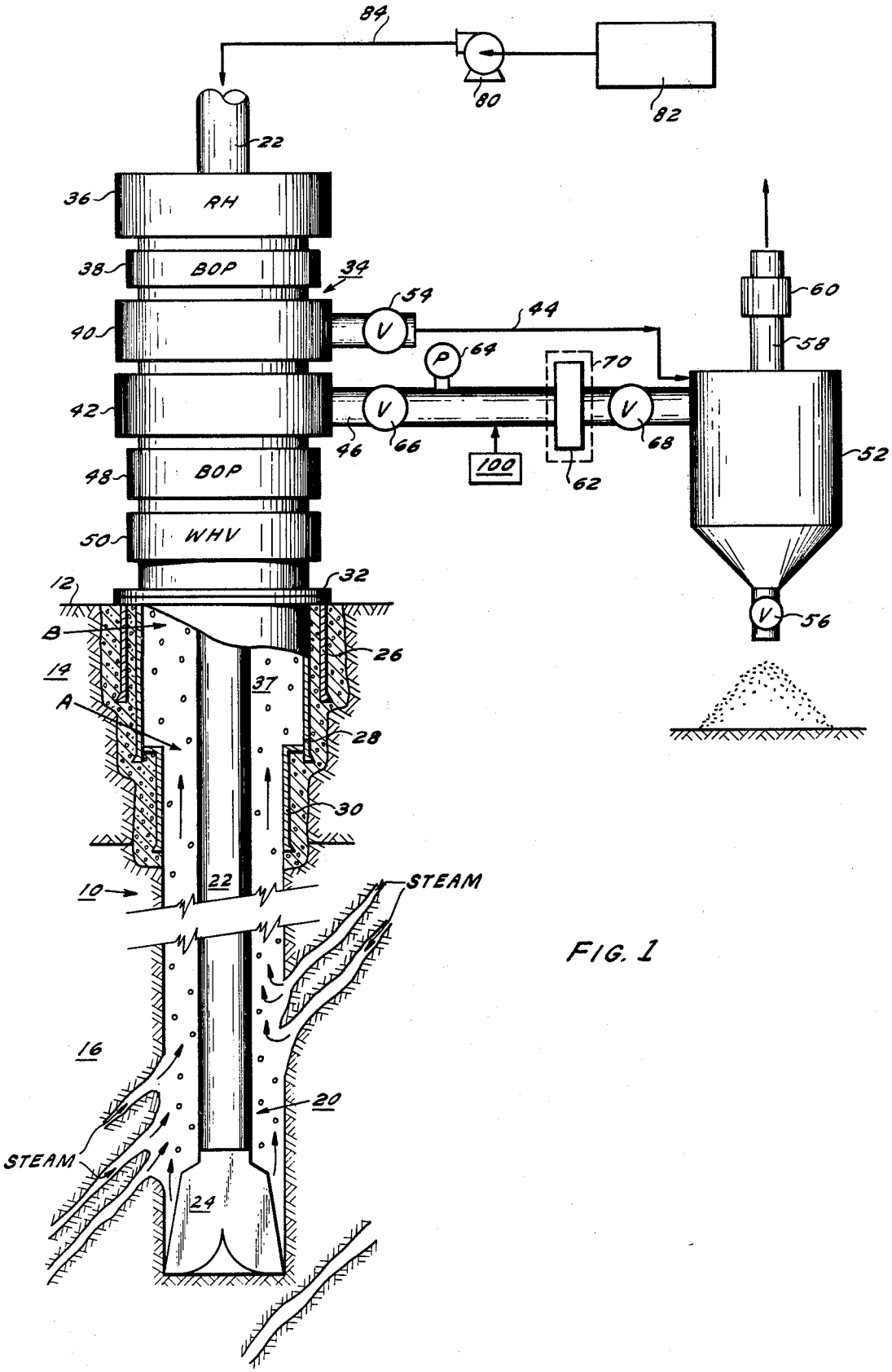
FIG. 1 is a schematic diagram of a cross-section of earth strata penetrated by a well, which illustrates an apparatus suitable for use in practicing a preferred embodiment of the method of the invention.

Apparatus suitable for use in a preferred embodiment of the method of the invention is illustrated in FIG. 1. A well, shown generally as 10, extends from earth surface 12 through overburden 14 and into steam-bearing formation 16. Below formation 16 is a fluid- and/or mineral-bearing reservoir, not shown, containing steam, high temperature brine, oil, gas or a mineral deposit of interest. The objective of the drilling operation is to extend well 10 into this reservoir to tap the fluid contained therein, or obtain samples of the mineral deposit.

A drill string, shown generally as 20, is disposed in well 10 in a conventional manner. Drill string 20 includes drill pipe 22 and drill bit 24 which is attached to the lower end of drill pipe 22 and held in engagement with the bottom of well 10. The top of well 10 is fluid-tightly sealed from overburden 14 by surface conductor 26, surface casing 28 and well liner 30 each of which has been cemented in place in a conventional manner.

Casinghead 32 provides a fluid-tight seal from surface casing 28 to the wellhead apparatus, shown generally as 34. Proceeding from top to bottom, wellhead 34 includes: rotating head 36 for rotatably sealing the top of well annulus 36 around drill pipe 22; blow-out prevention valve 38; banjo boxes 40 and 42 for diverting the flow of gas from well annulus 37 to blooie lines 44 and 46, respectively; blowout prevention valve 48; and wellhead control valve 50. Wellhead apparatus 34 is of a conventional design with the exceptions that banjo box 42 and blooie line 46 are provided in addition to the conventional banjo box 40 and blooie line 44, and also that rotating head 36 must be designed for operation at higher temperatures and pressures than are normally encountered in the prior art gas drilling operations. The design of rotating head 36 is, however, within the skill of the art, and a suitable rotating head is available from the Grant Oil Tool Company of Los Angeles, Calif.

In the conventional manner, blooie line 44 conducts the well effluent from well annulus 37 to vent pipe 58 via solids separator 52. Blooie line 44 is designed to have a minimal pressure-reducing effect on the well effluent as is separator 52, accordingly the fluid entering blooie line 44 from banjo box 40 is at essentially atmospheric pressure during conventional gas drilling operations. Block valve 54 is provided on blooie line 44 to prohibit flow therethrough when blooie line 44 is not in use.

Separator 52 can be any type of gas/solid separator suitable for separating entrained solid particles from a large volume, high velocity gas stream, including filters, baffle chambers, cyclones and other devices well known in the art. Cyclones are generally preferred for this service due to their low cost and low pressure drop characteristics. A solids-bearing gas is introduced into a vertically disposed, large diameter cylindrical section of the cyclone along a tangent thereto and is caused to swirl downwardly through the cyclone to a vertically oriented vent pipe. The swirling movement coupled with the abrupt change in direction and velocity upon entering the vent pipe causes the larger entrained solids to drop out of the carrier gas and fall to the bottom of the cyclone. Cyclones and other separating devices conventionally used in gas drilling operations adequately remove relatively large solid particles, such as particles above about 10 microns in diameter, but fail to adequately remove a substantial portion of any smaller particles. Separated particles are removed from separator 52 through valve 56 and the gas, which still contains finely-divided solid particles, is vented from separator 52 through vent pipe 58 to the atmosphere. The particulate emissions using this prior art method can become excessive upon steam entry into the borehole for the reasons stated above.

Blooie line 46 also conducts the well effluent from well annulus 37 to separator 52, but, in accordance with the method of this invention, flow restricting device 62 and, optionally, pressure gauge 64 are provided in blooie line 46 to impose and monitor, respectively, a surface back pressure on the steam- and contaminant-bearing gas rising through well annulus 37. Optionally, sound insulation 70 can be provided to attenuate noise caused by the flow of the well effluent through flow restricting device 62. Flow restricting device 62 can be an orifice plate, a venturi tube, an adjustable throttle valve or other equivalent flow restricting device known in the art. Orifice plates and venturi tubes are preferred over adjustable valves for their simplicity and low cost. A field test has surprisingly shown that adjustable valves are often not required and do not exhibit any significant advantages over a fixed orifice device, such as a venturi tube or orifice plate. Rather, the reduction in particulate emissions achieved by the method of this invention does not appear to require overly fine adjustment of the surface back pressure. Block valves 66 and 68 are provided to block in blooie line 46 when not in use.

Wellhead apparatus 34 is, of course, merely exemplary of suitable wellhead devices and many obvious modifications can be made thereto. For example, it is contemplated that a single banjo box and blooie line would suffice where the blooie line has means for bypassing the flow restricting device when not in use, such as prior to steam entry.

The gaseous drilling fluids useful in the method of this invention include, but are not limited to, air, nitrogen, natural gas, flue gas, combustion gas, and other relatively inert gases available in sufficient quantities for the drilling of a well. Air is perhaps the most commonly used gaseous drilling fluid since it is obtainable directly from the atmosphere. However, where the use of air leads to unacceptable corrosion rates in the well, nitrogen, combustion gas or flue gas is preferred with relatively pure nitrogen being particularly preferred. The source of nitrogen will generally be a pressurized container such as a pressurized tank truck. On the other hand, flue gas or combustion gas may be readily available from some other source, such as a power plant located near the drilling site.

Various additives may be incorporated into the gaseous drilling fluid to aid in preventing corrosion and/or erosion of the metal well hardware. Preferred additives include corrosion and erosion inhibitors of the type described in U.S. Pat. Nos. 3,653,452, 3,743,554 and 4,092,252. The method of use and composition of these additives are fully described in these patents, the disclosures of which are herein incorporated by reference.

During the gas drilling operation, drill bit 24 is rotated in engagement with the bottom of the borehole by a prime mover, not shown, and a gaseous drilling fluid is circulated by compressor 80 from drilling fluid source 82 through line 84, and downwardly through drill pipe 22 to drill bit 24. Drilling cuttings produced by the action of drill bit 24 are entrained in the gaseous drilling fluid and conveyed upwardly through well annulus 37 to the earth surface. While the invention is herein described in terms of the conventionally preferred circulation of the drilling fluid downwardly through the drill pipe and upwardly through the well annulus, reverse circulation can also be used successfully with the appropriate changes in well equipment.

Prior to encountering steam-bearing formation 16, the solids-bearing gas rising through well annulus 37 is routed through blooie line 44 and separator 52 for separation of the large entrained solids from the gas, and the separated gas is exhausted through vent pipe 58 to the atmosphere. Optionally, silencer 60 is provided to muffle the noise generated by the vented gas. The solids-bearing gas rising through well annulus 37 at this point in the drilling operation consists essentially of the gaseous drilling fluid and the entrained solid particles which are primarily drilling cuttings but may include some formation particles sloughed into the well. This phase of the drilling operation is conventional.

In the gas drilling of a well, there exists a critical point in the well at which the velocity of the solids-bearing gas rising through the well is at a minimum. Usually the velocity is a minimum at a point where the diameter of the well is changed from a small diameter to a larger diameter. The location of this critical point, hereinafter the "minimum velocity point," is not necessarily the same location throughout the drilling operation, since the use of additional well liners and/or reduced diameter boreholes in extensions of the well can introduce another sharp change in well diameter. Of course, steam entry at various depths in the well may also change the location of the minimum velocity point. The location of the minimum velocity point at any stage of the gas drilling operation is easily determined by calculations and/or measurements well known to those skilled in the art.

The volumetric injection rate of the drilling fluid into well 10 through drill pipe 22 is selected such that the velocity of the gas rising through well annulus 37 is at least that velocity required to lift the drilling cuttings past the minimum velocity point, and preferably a margin of safety is provided. As a practical matter, the injection rate is usually determined by the capacities of the available compressors, i.e., if one compressor does not supply a sufficient volumetric flow rate, a second compressor is added with both compressors operating at their capacity. At the relatively low annular velocities employed, the entrained solid particles pass through well annulus 37 without an excessive amount of abrasion, and arrive at the earth surface as relatively large particles. A typical circulation rate when air is used as the drilling fluid is about 10,000 pounds per hour which is equivalent to about 2,100 standard cubic feet per minute.

Upon encountering steam-bearing formation 16, steam enters the borehole and flows upwardly through well annulus 37 with the gaseous drilling fluid and drilling cuttings. The contaminant-bearing gas rising through well annulus under these circumstances comprises the gaseous drilling fluid, drilling cuttings and other particulate solids, and steam. The steam may also contain various chemical contaminants, including sulfurous compounds, such as hydrogen sulfide, nitrous compounds, such as ammonia, and hydrocarbon gases, such as methane.

Steam entry rates vary from 0 to 250,000 pounds per hour, and higher. High contaminant emissions are observed at steam entry rates as low as 50,000 pounds per hour and usually become excessive at steam entry rates on the order of 100,000 pounds per hour, and higher. These steam entry rates increase the velocity of the solids-bearing gas rising through well annulus 37 to velocities in the order of 5 to 25 times the velocity prior to steam entry. Steam entry is readily apparent from the appearance and increased volume of the gas exhausted from vent pipe 58.

A second critical point in the well is the point at which the velocity of the solids-bearing gas rising through the well is a maximum. Upon steam entry into the well, this "maximum velocity point" is generally the location at which the erosion and corrosion of metal surfaces and the diminution of drilling cuttings is most severe. As the gas rises through the well the pressure of the gas is reduced. In the prior art methods the pressure of the gas is reduced from the bottomhole pressure to essentially atmospheric pressure at the earth surface, which of course results in a substantial increase in the volume and therefore velocity of the gas. This large reduction in pressure often results in gas velocities at the earth surface which are 10 to 20 times the gas velocity at the bottom of the well. Accordingly the maximum velocity point is usually located relatively near the earth surface, either within the wellhead itself or at the top end of the surface casing. The location of the maximum velocity point generally will not change during the drilling operation.

By way of example, surface conductor 26 can be a 26-inch diameter conduit extending from the earth surface to a depth of 200 to 300 feet; surface casing 28 can be a 3⅜-inch diameter conduit extending from the earth surface to a depth of 1500 to 2000 feet; well liner 30 can be a 9⅝-inch diameter conduit extending from a depth of 1000 to 1800 feet to a depth of 3500 to 5500 feet, generally to the top of steam-bearing formation 16; and a 8¾-inch hole is extended through steam-bearing formation 16 into the reservoir of interest. In this arrangement of the well the minimum velocity point is often located at the transition between the top of the 9⅝-inch liner and the bottom of the 13⅜-inch casing, shown as point A on FIG. 1, and the maximum velocity point is often located at the top of the 13⅜-inch casing, as shown as point B.

In accordance with the method of this invention, the conventional gas drilling operation is continued until significant steam entry into the well is observed, at which time block valves 66 and 68 are opened to allow flow of well effluent through blooie line 46 and flow restricting device 62 to separator 52, and block valve 54 is closed to prohibit flow through blooie line 44. Flow through restricting device 62 imposes a surface back pressure on the contaminant-bearing gas rising through well annulus 37. Pressure gauge 64 indicates the amount of back pressure imposed, and the indicated value can be used in adjusting flow restricting device 62, if required, to impose the desired amount of surface back pressure.

The amount of surface back pressure required will depend, inter alia, upon the rate at which steam is entering the well, the pressure of the steam in formation 16, the capabilities of the separating device, the temperature and pressure limitations on the drilling equipment, and the result of the surface pressure on the velocity of the contaminant-bearing gas at the minimum velocity point and the maximum velocity point.

The velocity $V_x$ at locations, x, in the borehole is equal to the volumetric flow rate at that location, $Q_x$, divided by the cross-sectional area available for flow, $A_x$, i.e., $$V_x = Q_x / A_x$$

The surface back pressure imposed in the method of this invention reduces the volumetric flow rate $Q_x$, and therefore the velocity $V_x$, in the well by two distinct mechanisms. The back pressure will of course reduce the mass flow rate somewhat due to the increased resistance to flow, however, the major factor in reducing the velocity at the maximum velocity point in the well is the fact that the solids-bearing gas flowing past this location is at a much higher pressure, and therefore has a much smaller volumetric flow rate for the same mass flow rate.

The pressure, and therefore the volumetric flow rate, of the contaminant-bearing gas at the bottom of the borehole is not significantly changed when the surface back pressure is imposed. However, the pressures and volumetric flow rates of the contaminant-bearing gas at other locations in the well annulus are affected in that the pressure at the wellhead has been increased from essentially atmospheric pressure, such as from about 10 p.s.i.a. to about 20 p.s.i.a., to the imposed surface back pressure which can be as high as 400 p.s.i.a. or higher depending primarily upon the pressure and mass flow rate of the steam from the steam-bearing formation. Since the minimum velocity point is always located at a position lower in the well annulus than the maximum velocity point, a given surface back pressure will reduce the velocity at the minimum velocity point to a lesser extent than it will reduce the velocity at the maximum velocity point.

In general, the surface back pressure selected for use in the method of this invention will be the minimum back pressure which is sufficient to reduce the velocity of the contaminant-bearing gas at the maximum velocity point to a velocity less than the velocity at which unacceptable erosion of the drilling equipment and diminution of the drilling cuttings occur, which at the same time controls the velocity of the contaminant-bearing gas at the minimum velocity point at a value sufficient to clean the drilling cuttings and other solids from the borehole. The surface back pressure selected will generally be between about 50 and about 400 p.s.i.a. Surprisingly, even relatively small surface back pressures, such as from about 50 to about 250 p.s.i.a., result in substantially reduced erosion and contaminant emissions during gas drilling operations. There appears to be some minimum surface back pressure required to produce these beneficial results, and that minimum back pressure varies from well to well depending primarily upon the well configuration and the separation capabilities of the device used to separate the drilling cuttings from the well effluent.

Preferably the surface back pressure is selected to control the velocity of the contaminant-bearing gas at the minimum velocity point between about 1.1 and about 6 times the lowest velocity required to transport the drilling cuttings to the earth surface, and good results are achieved when the surface back pressure is selected to control this velocity between about 1.2 and about 4 times the lowest velocity required to transport the drilling cuttings to the earth surface.

Expressed in another way, the surface back pressure is selected to reduce the velocity of the contaminant-bearing gas at the maximum velocity point to between about 0.05 and about 0.5 times the velocity at this point when only atmospheric back pressure is imposed, and good results are achieved when the surface back prssure is selected to reduce the velocity at the maximum velocity point to between about 0.1 to 0.3 times the velocity at this point under only atmospheric back pressure.

The above-described criteria for selecting the surface back pressure will generally lead to the selection of the same ranges of suitable surface back pressures, i.e., the criteria are generally overlapping if not completely coincident, depending primarily upon the steam pressure and steam production rate from the subterranean formation being penetrated. For example, during the drilling of a well through a steam-bearing formation having a steam-pressure of about 500 p.s.i.a. and a steam production rate of about 90,000 pounds per hour under the conditions of the gas drilling operation, a surface back pressure between about 50 p.s.i.a. and about 250 p.s.i.a. imposed on the contaminant-bearing gas rising through the well annulus will generally control the velocity at the minimum velocity point between about 1.2 and about 4 times the lowest velocity required to clean the well and will also reduce the velocity at the maximum velocity point to between about 0.02 and about 0.05 times the velocity which would exist at that point under only atmospheric back pressure. Of course, the surface back pressure selected need not meet all these criteria so long as the surface back pressure selected is sufficient to reduce the erosion of the well hardware and to reduce the contaminant emissions.

Figure 2:
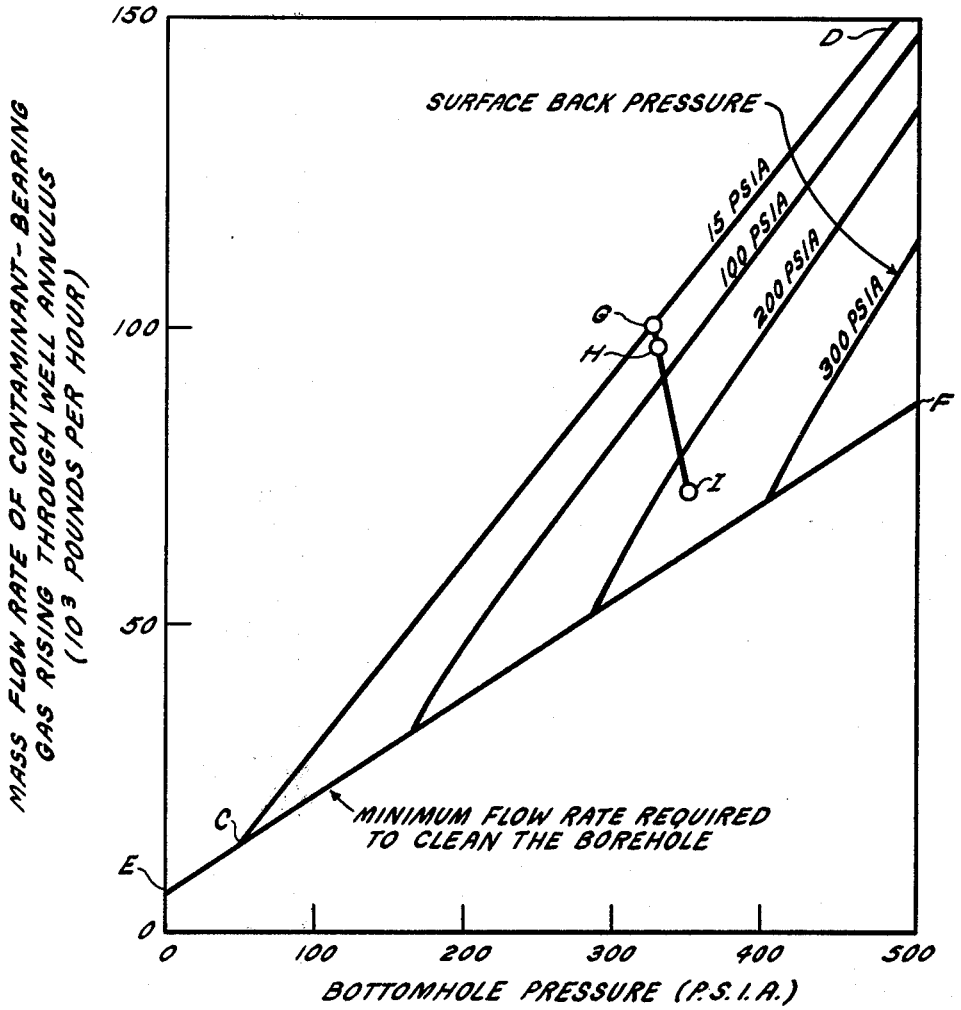
FIG. 2 is a graph illustrating the calculated production rates during a gas drilling operation for various combinations of bottomhole pressures and surface back pressures.

FIG. 2 is a graph illustrating various operating conditions which could be encountered during the drilling of a well into a subterranean steam-bearing formation. The graph is based on a well configuration of: a 13⅜-inch casing from the earth surface to a depth of 2,000 feet, a 9⅝-inch well liner from 2,000 feet to 4,000 feet, a 8½-inch hole from 4,000 feet to the steam entry point at 5,000 feet, and 4½-inch drill string in the hole. FIG. 2 illustrates the calculated mass flow rates of the contaminant-bearing gas rising through the well for various bottom-hole pressures and surface back pressures.

Line C-D represents the operating conditions which would be encountered using the prior art gas drilling method in which the contaminant-bearing gas arrives at the earth surface at essentially atmospheric pressure (15 p.s.i.a.) Line E-F represents the minimum mass flow rate required to clean the borehole. The operating conditions employed in the method of this invention are found between line C-D and line E-F, such as the operating conditions indicated by points H and I.

Preferably a graph of predicted operating conditions similar to FIG. 2 is constructed prior to drilling each well based on the knowledge of other wells in the area and/or based on geophysical data. The graph is then referred to during the drilling operation to allow readjustments of the surface back pressure within the operable conditions.

In a preferred embodiment of the method of this invention, flow restricting device 62 is installed in blooie line 46 to impose a surface back pressure on the well effluent during steam entry into the well and injection device 100 for the injection of a treating fluid into the well effluent is installed upstream of restricting device 62, preferably between wellhead 34 and restricting device 62, as shown in FIG. 1. Injection ports, spray nozzles and other equivalent injection devices are suitable for injection of the treating fluid and are preferably designed to promote good contacting of the treating fluid with the well effluent in blooie line 46.

Positioning injection device 100 in blooie line 46 at a point upstream from flow restricting device 62 results in a surprisingly superior reduction in contaminant emissions by increasing the efficiency of the contacting process. The imposed surface back pressure not only reduces the mass flow rate of the contaminant-bearing gas to some extent, it also increases the volumetric concentration of the contaminants in the gas to be treated and increases the time available for contacting the gas with the treating fluid. The increased contacting time and contaminant concentration result in improved contacting efficiency and therefore lower contaminant emissions.

The treating fluid can be any liquid which physically or chemically alters the contaminants in the well effluent to thereby enhance removal of the same, or chemical conversion thereof to environmentally innocuous compounds. For example, water can be injected through device 100 to wet the finely divided drilling cuttings to agglomerate these particles to form larger, more easily separated particles. Of particular concern in many drilling operations is the emission of chemical contaminants, including sulfurous compounds, such as hydrogen sulfide, nitrous compounds, such as ammonia, and hydrocarbon gases, such as methane. Various treating fluids suitable for the conversion of these noxious compounds to innocuous compounds are well known, including both acidic and alkaline solutions. A preferred treating fluid for removing hydrogen sulfide from the well effluent is an aqueous alkaline solution containing an alkali metal hydroxide and hydrogen peroxide. An exemplary treating fluid is an aqueous solution containing from about 10 to about 15 weight percent of sodium hydroxide and from about 20 to about 40 weight percent of hydrogen peroxide, with the solution being injected at a rate sufficient to provide at least a stoichiometric amount of hydrogen peroxide for the conversion of hydrogen sulfide to sulfur. Preferably the molar ratio of hydrogen peroxide to sodium hydroxide to hydrogen sulfide in the treating fluid is between about 4:1:1 and about 20:2:1. The injection of aqueous liquids also serves to wet and agglomerate fine particulate materials thereby facilitating their separation in separator 52.

This invention is further described by the following example which is illustrative of a specific mode of practicing the invention and is not intended as limiting the scope of the invention as defined by the appended claims.

EXAMPLE

A well is to be drilled into a subterranean geothermal reservoir containing steam at a pressure of about 500 p.s.i.a. The anticipated well configuration is used to construct a graph, FIG. 2, of operating conditions expected during the gas drilling phase of the operation. The top portion of the well is drilled using conventional rotary drilling techniques and an aqueous based drilling fluid. A surface casing and well liner are cemented in place in the conventional manner to seal the well from the over-burden. Thereafter, the well is drilled using air as the gaseous drilling fluid.

In stage one of the gas drilling operation, i.e., prior to steam entry, the mass flow rate of the gaseous drilling fluid which is required to clean the borehole is determined to be about 10,000 pounds per hour. The velocity of the solids-bearing gas rising through the well annulus under these conditions is about 45 feet per second at the minimum velocity point and about 46 feet per second at the maximum velocity point.

In stage two of the gas drilling operation, i.e. after steam entry, the gaseous drilling fluid continues to be introduced into the drill string at a rate of about 10,000 pounds per hour, however the entry of steam into the borehole increases the mass flow rate of the contaminant-bearing gas rising through the well annulus to about 100,000 pounds per hour. During stage two the contaminant-bearing gas arrives at the earth surface at essentially atmospheric pressure (approximately 15 p.s.i.a.). The operation conditions of this stage of the drilling operation are indicated by point G on FIG. 2. The drilling penetration rate is determined to be about 20 feet per hour.

Then during stages three and four of the gas drilling operation, in accordance with the method of this invention, the gaseous drilling fluid continues to be injected at a rate of about 10,000 pounds per hour and two different surface back pressures are imposed on the contaminant-bearing gas rising through the well annulus. In stage three, an orifice plate having an orifice of about 6-inches in diameter is installed in the blooie line, which results in a surface back pressure of about 75 p.s.i.a. In stage four, an orifice plate having an orifice of about 3-inches in diameter is installed in the blooie line, which results in a surface back pressure of about 245 p.s.i.a. The penetration rates for stages three and four are determined to be essentially the same as in stage two of the operation. Points H and I on FIG. 2 illustrate the operating conditions in stages three and four, respectively, of the drilling operation using the method of this invention.

In stages two through four of the operation, water is injected into the blooie line just upstream from the cyclone separator in order to wet the entrained finely divided particles so that a visual comparison of the particles produced by the various stages of the drilling operation can be made. The velocities of the contaminant-bearing gas at the minimum and maximum velocity points in the well are calculated and compared in the following Table.

TABLE

| Stage No. | Surface Back Pressure (p.s.i.a.) | Contaminant-Bearing Gas Rising Through The Well: Mass Flow Rate (lb./hr.) | Gas Velocity (ft./sec.) Maximum | Gas Velocity (ft./sec.) Minimum | Appearance of the Solids in the Slurry Discharged from the Bottom of Separator |
|---|---|---|---|---|---|
| 1 | 15 | 10,000[a] | 46 | 45 | — |
| 2 | 15 | 100,000 | 824 | 255 | Very Fine - Individual Particles Cannot be Seen Without Magnification |
| 3 | 75 | 97,000 | 217 | 164 | Individual Particles are Visible, Approximately 1/16 to 1/8-inch in Diameter |
| 4 | 245 | 72,000 | 51 | 50 | Individual Particles are Visible, No Detectable Difference From Stage 3 |

[a]Prior to Steam Entry

Inspections of the drill string between the various stages of the drilling operation indicate that the erosion of the drill string is substantially reduced during the stages which employed the method of this invention, stages three and four, as compared to the prior art method used in stage two. This example therefore illustrates the substantial improvement in terms of reduced erosion of the drill string and reduced diminution in size of the drilling cuttings which are realized in the method of this invention.

While particular embodiments of the invention have been described it will be understood, of course, that the invention is not limited thereto since many obvious modifications can be made, and it is intended to include within this invention any such modifications as will fall within the scope of the appended claims.

Having now described the invention, I claim:

1. A method for drilling a borehole through a steam-bearing subterranean formation, comprising the steps of:

(a) rotating a drill bit in engagement with the bottom of said borehole thereby drilling said borehole and producing particulate drilling cuttings;

(b) flowing a gaseous drilling fluid from the earth surface downwardly through a first fluid pathway to said drill bit;

(c) flowing from the bottom of said borehole upwardly through a second fluid pathway to the earth surface a contaminant-bearing gas comprised of said gaseous drilling fluid, said drilling cuttings and steam produced from the steam-bearing formation being penetrated, said second fluid pathway having a minimum velocity point at a first location wherein the velocity of said contaminant-bearing gas is a minimum and a maximum velocity point at a second location above said first location wherein the velocity of said contaminant-bearing gas is a maximum;

(d) imposing a preselected surface back pressure on said contaminant-bearing gas, said surface back pressure being an amount effective to reduce the velocity of said contaminant-bearing gas at said maximum velocity point to a value less than the velocity at which substantial erosion of well hardware and substantial diminution of the drilling cuttings occurs and to control the velocity of said contaminant-bearing gas at said minimum velocity point at a value sufficient to transport said drilling cuttings through said borehole, whereby the erosion of said well hardware is reduced and said drilling cuttings arrive at the earth surface as relatively large, easily separated particles; and (e) venting at least a portion of said contaminant-bearing gas to the atomsphere.

2. The method defined in claim 1 including the step of, prior to step (e), separating at least a substantial portion of said drilling cuttings from said contaminant-bearing gas to form a vent gas substantially free of particulate material, and venting said vent gas to the atmosphere in step (e).

3. The method defined in claim 1 wherein said preselected surface back pressure is imposed by passing said contaminant-bearing gas through a flow restricting device located at the earth surface.

4. The method defined in claim 3 wherein said flow restricting device is an orifice plate, a venturi tube, a throttle valve, a choke bean or a combination thereof.

5. The method defined in claim 3 wherein said contaminant-bearing gas further comprises a chemical contaminant selected from the group consisting of hydrogen sulfide, entrained brine, ammonia and methane, and including the step of contacting said contaminant-bearing gas with a treating fluid at a point upstream from said flow restricting device to remove said chemical contaminant from said contaminant-bearing gas.

6. The method defined in claim 5 wherein said chemical contaminant is hydrogen sulfide and said treating fluid is an aqueous alkaline solution containing hydrogen peroxide.

7. The method defined in claim 6 wherein said treating fluid is an aqueous solution containing from about 10 to about 15 weight percent of sodium hydroxide and from about 20 to about 40 weight percent of hydrogen peroxide and wherein said treating fluid is used in an amount sufficient to provide a molar ratio of hydrogen peroxide to sodium hydroxide to hydrogen sulfide between about 4:1:1 and about 20:2:1.

8. The method defined in claim 1 wherein said preselected surface back pressure is between about 50 p.s.i.a. and about 400 p.s.i.a.

9. The method defined in claim 1 wherein said surface back pressure is selected to control the velocity at said minimum velocity point between about 1.1 and about 6 times the lowest velocity required to transport said drilling cuttings through said second fluid pathway to the earth surface.

10. The method defined in claim 1 wherein said surface back pressure is selected to control the velocity at said minimum velocity point between about 1.2 and about 4 times the lowest velocity required to transport said drilling cuttings through said second fluid pathway to the earth surface.

11. The method defined in claim 1 wherein said surface back pressure is selected to control the velocity at said maximum velocity point to between about 0.05 and about 0.5 times the velocity which would exist at said maximum velocity point under only atmospheric back pressure.

12. The method defined in claim 1 wherein said surface back pressure is selected to control the velocity at said maximum velocity point to between about 0.1 and about 0.3 times the velocity which would exist at said maximum velocity point under only atmospheric back pressure.

13. A method for drilling a borehole through a steam-bearing subterranean formation, comprising the steps of:

(a) rotating a drill bit in engagement with the bottom of said borehole thereby drilling said borehole and producing particulate drilling cuttings;

(b) flowing a gaseous drilling fluid from the earth surface downwardly through a first fluid pathway to said drill bit;

(c) flowing from the bottom of said borehole upwardly through a second fluid pathway to the earth surface a contaminant-bearing gas comprised of said gaseous drilling fluid, said drilling cuttings and steam produced from the steam-bearing formation being penetrated, said second fluid pathway having a minimum velocity point at a first location wherein the velocity of said contaminant-bearing gas is a minimum and a maximum velocity point at a second location above said first location wherein the velocity of said contaminant-bearing gas is a maximum;

(d) passing said contaminant-bearing gas through a flow restricting device to impose a surface back pressure between about 50 and about 250 p.s.i.a. on said contaminant-bearing gas, said surface back pressure being an amount effective to reduce the velocity of said contaminant-bearing gas at said maximum velocity point to a value less than the velocity at which substantial erosion of well hardware and substantial diminution of the drilling cuttings occurs and to control the velocity of said contaminant-bearing gas at said minimum velocity point between about 1.1 and about 6 times the lowest velocity required to transport said drilling cuttings through said second fluid pathway to the earth surface, whereby the erosion of said well hardware is reduced and said drilling cuttings arrive at the earth surface as relatively large, easily separated particles;

(e) separating at least a substantial portion of said drilling cuttings from said contaminant-bearing gas to form a vent gas substantially free of particulate material; and (f) venting said vent gas to the atmosphere.

14. The method defined in claim 13 wherein said contaminant-bearing gas further comprises a chemical contaminant selected from the group consisting of hydrogen sulfide, entrained brine, ammonia and methane, and including the step of contacting said contaminant-bearing gas with a treating fluid at a point upstream from said flow restricting device to remove said chemical contaminant from said contaminant-bearing gas.

15. The method defined in claim 14 wherein said chemical contaminant is hydrogen sulfide and said treating fluid is an aqueous solution containing hydrogen peroxide.

16. The method defined in claim 15 wherein said treating fluid is an aqueous solution containing from about 10 to about 15 weight percent of sodium hydroxide and from about 20 to about 40 weight percent of hydrogen peroxide and wherein said treating fluid is used in an amount sufficient to provide a molar ratio of hydrogen peroxide to sodium hydroxide to hydrogen sulfide between about 4:1:1 and about 20:2:1.

17. The method defined in claim 13 wherein said surface back pressure is selected to control the velocity at said maximum velocity point to between about 0.05 and about 0.5 times the velocity which would exist at said maximum velocity point under only atmospheric back pressure.

* * * * *

UNITED STATES PATENT AND TRADEMARK OFFICE

CERTIFICATE OF CORRECTION

PATENT NO. : 4,161,222

DATED : July 17, 1979

INVENTOR(S) : DAVID S. PYE

It is certified that error appears in the above-identified patent and that said Letters Patent are hereby corrected as shown below:

In column 1, line 25, change "and" (first occurrence) to read --the--, and line 44, change "removel" to read --removal.

In column 14, (claim 15) line 38, after "aqueous" insert --alkaline--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*